United States Patent [19]

Breen et al.

[11] Patent Number: 4,601,302

[45] Date of Patent: Jul. 22, 1986

[54] CANE HAVING HANDLE WITH STOP MEMBER

[76] Inventors: Jonathon Breen, Box 53, Fort Whyte, Manitoba, Canada, R0G 0R0; Drew Petursson, 960 Lemay St., Winnipeg, Manitoba, Canada, R3V 1E8

[21] Appl. No.: 580,370

[22] Filed: Feb. 15, 1984

[51] Int. Cl.[4] ..... A45B 9/02; A61H 3/00; F16M 13/08

[52] U.S. Cl. ..... 135/66; 135/78

[58] Field of Search ..... 135/72, 76, 65, 66, 135/73, 74, 75, 76, 77, 84, DIG. 10, DIG. 11, 78, 79, 80, 81, 82, 83, 17, 18; 248/155, 155.1, 155.2, 155.3, 155.4, 155.5; 16/110 R, 115, 114 R; D3/7, 8, 9

[56] References Cited

U.S. PATENT DOCUMENTS

| | | | |
|---|---|---|---|
| 90,498 | 5/1869 | Chapman | 135/65 |
| 442,048 | 12/1890 | Höfel | 135/65 |
| 2,210,493 | 8/1940 | Lisi | 135/66 |
| 2,409,365 | 10/1946 | Lamb | 135/71 |
| 4,085,763 | 4/1978 | Thomas | 135/75 X |
| 4,314,576 | 2/1982 | McGee | 135/67 |
| 4,481,964 | 11/1984 | Minneman | 135/66 |

FOREIGN PATENT DOCUMENTS

| | | | |
|---|---|---|---|
| 319449 | 3/1920 | Fed. Rep. of Germany | 135/66 |
| 14106 | of 1904 | United Kingdom | 248/155.4 |
| 2110081 | 6/1983 | United Kingdom | 135/DIG. 10 |

*Primary Examiner*—Robert A. Hafer
*Assistant Examiner*—Arnold W. Kramer
*Attorney, Agent, or Firm*—Stanley G. Ade; Adrian D. Battison

[57] ABSTRACT

An ambulatory aid in the form of a cane is manufactured from plastics material including a handle and a stick portion. The stick portion is formed in two sections, one having a male screw thread and the other having a female screw thread so that the axial length can be adjusted by screwing one into the other and then locking with a lock nut. The screw threads are formed of moulded plastic material in tubular form with a tubular metal insert. The handle is shaped with an inclined upper surface leading downwardly to an upward stop. The upper surface is positioned directly above the vertical axis of the stick.

13 Claims, 7 Drawing Figures

CANE HAVING HANDLE WITH STOP MEMBER

BACKGROUND OF THE INVENTION

This invention relates to an ambulatory aid which may be a walking cane having either a single tip or a four-legged bottom otherwise known as a quad bottom or may be in some cases a crutch.

Ambulatory aids of this type are intended to assist the walking of infirm patients and hence have design characteristics which are very different from novelty or other type canes which are not used by the infirm. It should be noted that for the infirm walking can often be a very difficult process and an effectively designed cane can improve the walking in an objectively measurable manner of patients and in some extreme cases can make the difference between a patient being effectively able to get about and otherwise being confined to a wheelchair.

Despite the importance of aids of this type, little development has been made in this area for many years and infirm patients are often left to use unsatisfactory equipment which does not assist their walking as much as otherwise could be possible and which in many cases serves to accentuate their difference from the normally ambulatory population.

It is one object of the present invention, therefore, to provide an improved ambulatory aid which because of its design in the handle area and also its construction of the stick portion provides an improved structure in terms of its handling, length adjustment and in some cases weight.

According to a first aspect of the invention, therefore, there is provided a walking cane comprising a stick portion and a handle, the handle comprising an elongate generally cylindrical hand grip portion which can be grasped by the hand of a user, which has a forward end and a rear end and which lies generally at right angles to the length of the stick portion, and a hand engaging stop member projecting outwardly from the forward end of the hand grip portion, the handle being shaped such that, with the stick portion vertical, the upper surface of the hand grip portion is inclined downwardly toward the stop member and such that an extrapolation of the stick portion intersects the hand grip portion intermediate its length.

According to a second aspect of the invention, there is provided an ambulatory aid comprising a stick portion and a handle, the stick portion being formed from two separate cylindrical sections, one having a male screw thread on the outer surface thereof and the other having an axial bore at one end for receiving the first section and a cooperating female screw thread on the surface of the bore whereby the axial extent of the stick portion can be adjusted by rotating one section relative to the other, and a lock collar having an internal screw thread for cooperating with the male screw thread to lock the section in a desired adjusted position, the lock collar and screw threads of the sections being moulded from an instant setting polymeric material.

According to a third aspect of the invention there is provided an ambulatory aid comprising a stick portion and a handle, both moulded from instant setting polymeric material, the stick portion being tubular and formed with a rigid metal tube inside, coaxial and integral with the moulded tube.

The handle therefore is particularly shaped so that the weight of the user is directly positioned above the cane so the cane even from a position behind the user tends to fall forward with the hand of the user as the body of the user also moves forward. The handle is also shaped so that the hand of the user tends to slide towards the stop and therefore remains accurately and firmly within the hand of the user even when the user has a poor grip as is often the case with particularly infirm patients. Furthermore, the user can either hold the handle with the hand resting against the stop or in some cases as preferred by some patients, the user can grasp the top of the handle, that is the top of the inclined hand grip portion rearwardly of the stop, in a particularly effective and suitable manner.

The construction of the stick portion formed from two tubular members is particularly effective in producing a lightweight cane which also can be accurately adjusted to very fine limits to obtain exactly the right length for the particular user involved. Furthermore, the structure of the cane allows it to be readily modified to incorporate what is known as a quad bottom should the cane be used by another patient or should the patient become less able and thus requiring more assistance.

With the foregoing in view, and other advantages as will become apparent to those skilled in the art to which this invention relates as this specification proceeds, the invention is herein described by reference to the accompanying drawings forming a part hereof, which includes a description of the preferred typical embodiment of the principles of the present invention, in which:

DESCRIPTION OF THE DRAWINGS

In the drawings like characters of reference indicate corresponding parts in the different figures.

DETAILED DESCRIPTION

Figures 1, 2, 3, 4:
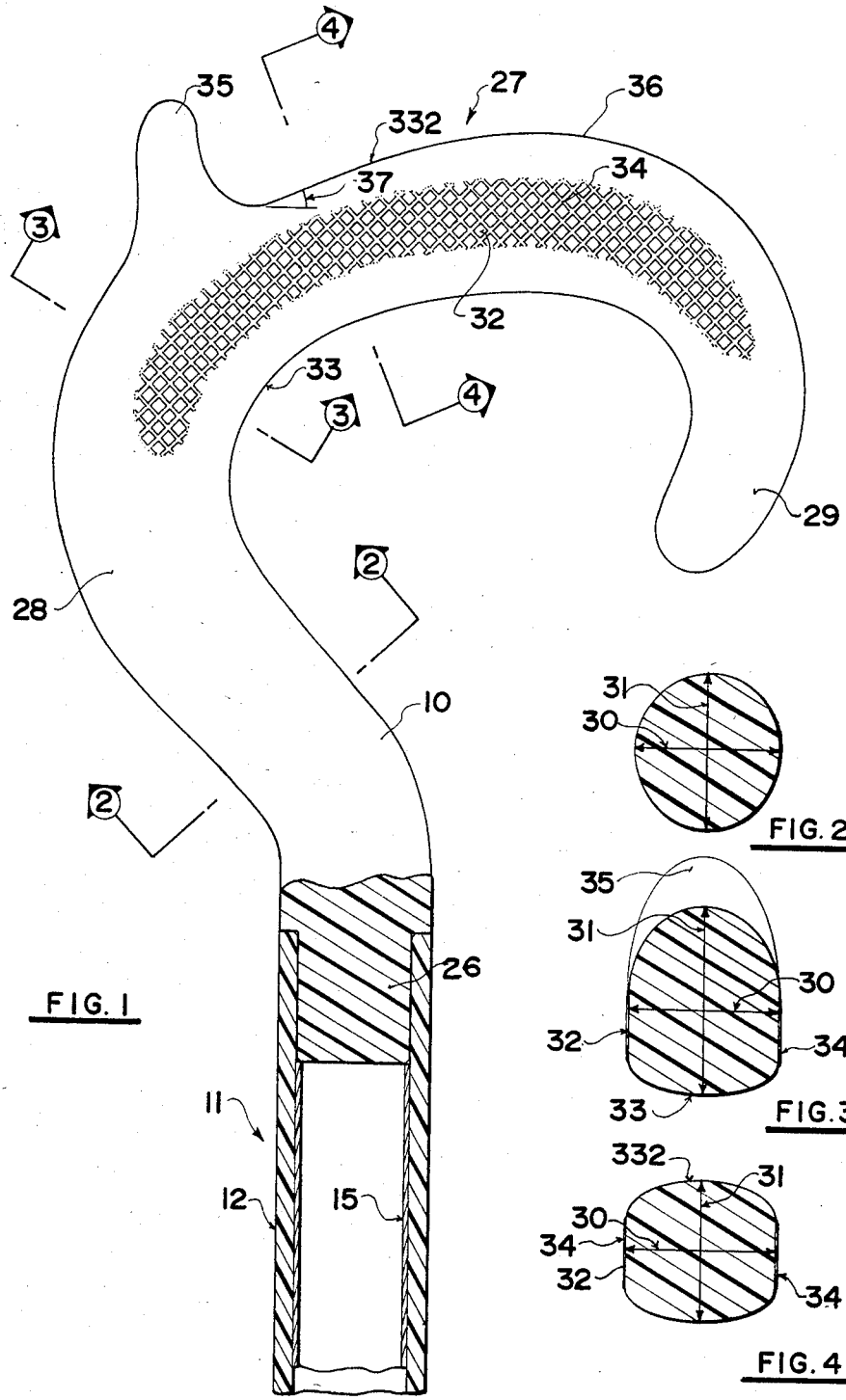
FIG. 1 is a side elevational view of a handle for a walking cane showing the interconnection between the handle and the stick portion in cross-section.
FIG. 2 is a cross-sectional view along the lines 2—2 of FIG. 1.
FIG. 3 is a cross-sectional view along the lines 3—3 of FIG. 1.
FIG. 4 is a cross-sectional view along the lines 4—4 of FIG. 1.
Figure 5:
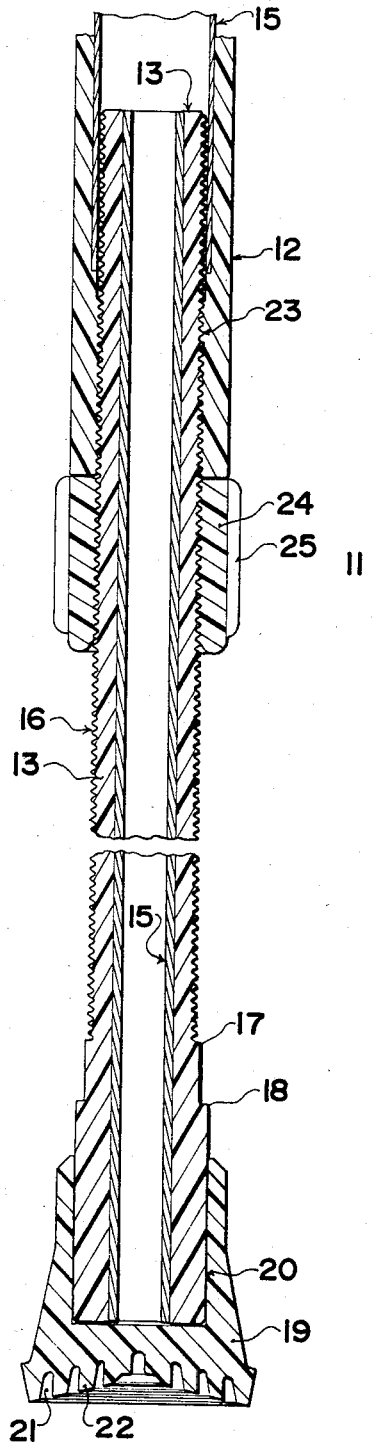
FIG. 5 is a cross sectional view of the stick portion of the cane of FIG. 1 showing the lower end of the stick portion.

A walking cane shown substantially in total in FIGS. 1 and 5 comprises a handle 10 and stick portion to which the handle is attached indicated 11. The stick portion 11 is formed in two sections, that is an upper and outer section 12 and a lower and inner section 13.

The handle 10 and the sections 12 and 13 are separately manufactured and are moulded by a foundry pouring technique from an instant setting polymeric material such as Duramax 100 which is available from licensees of Dow Company. This material is capable of forming large cross sections and sets in 30 seconds to a minute. Injection moulding techniques are not capable of forming the large cross sections necessary for the handle. As shown in FIGS. 2 through 4, the handle itself is solid and is moulded in a single piece.

As shown in FIGS. 1 and 5, the sections 12 and 13 are tubular and each has moulded on the inside thereof coaxially and integrally therewith a metal, preferably aluminum tube 15 of 0.035 inch wall thickness. The wall thickness of the section 12 is of 0.0625 inches and preferably in the range of 0.06 inches to 0.08 inches. The wall thickness of the section 13 which is of a smaller outer diameter, is 0.29 inches and preferably lies in the range of 0.27 inches to 0.31 inches. The outside diameter of the outer section 12 is approximately 1 inch which is convenient to provide a suitable size and weight of cane.

The tube 15 within the section 13 runs substantially the full length of the section 13. The tube 15 within the section 12 however, terminates at a distance approximately 1 inch to 1½ inches from each of the ends of the section 12.

Turning particularly to FIG. 5, it will be noted that the section 13 carries a male screw thread 16 on the outer surface thereof from the upper end thereof to a shoulder 17 and from shoulder 17 to the lower end is plane on the outer surface. A second shoulder 18 spaced from the first is also provided on the outer periphery of the plane section of the lower section 13 for reasons as will be explained in detail later. The lower smooth surface of the section 13 receives a polyurethane tip 19 which therefore provides some resilience to engage the ground and is simply a press fit onto the end of the section 13 so the bore 20 of the tip 19 engages the smooth outer surface of the section 13. The tip has a larger outer diameter to provide a greater ground engaging surface 21 which has a plurality of annular ribs 22 for gripping the ground.

The upper section 12 has an internal or female screw thread formed at the end section indicated at 23 beyond the end of the tube 15. The internal diameter of the screw thread 23 is less than that of the tube 15 so it can engage with the screw thread 16 of the section 13 while the screw thread 16 passes inside the tube 15 within the section 12. In this way the two sections can be adjusted in axial position by a screwing rotation along substantially the full length of the screw thread 16, of course, ensuring that sufficient overhang is provided to prevent twisting within the female screw thread of the portion 23. To set the adjusted position, an internally screw threaded lock nut 24 is provided which can screw on the screw thread 16 and is rotatable manually by ribs 25 on the outer surface so it can be screwed into locking engagement with the lower edge of the section 12.

The construction of the sections 12 and 13 in tubular form with the stiffening tubes 15 integral therewith provides a lightweight arrangement which has sufficient strength to take the weight of a user and also sufficient resistence to bending to give the user confidence in the resistence of the cane. Thus, a cane that is too flexible is in many cases unsatisfactory because although it may not break, the user lacks confidence in the strength of the product and also may have difficulty in view of the flexing. The use of this construction also allows the manufacture of the screw threads by a moulding technique so they can be economically manufactured and can provide the effectively infinitely variable adjustment obtainable by a screw thread technique. This arrangement has not been available commercially in such walking canes in view of the expense and difficulty of manufacturing screw threads of this type.

Turning now to FIG. 1, the upper end of the section 12 is shown in which the tube 15 terminates again about one inch to one and one-half inches from the top end of the section 12. This section free from the tube 15 provides an area for engagement with a shaft 26 projecting from an end of the handle 10. The shaft 26 is of reduced diameter relative to that of the handle 10 so that it can be received within the section 12 while the outer surface of the section 12 is contiguous with the outer surface of the handle 10. The shaft 26 is a shrink fit within the end of the section 12, that is heat applied to the section 12 at the end thereof expands the diameter sufficiently to allow the shaft 26 to be inserted whereupon cooling contracts the section 12 into rigid engagement with the shaft 26.

The handle 10 is generally hook shaped so as to provide a hand grip portion generally indicated at 27 which generally lies at right angles to or transversely to the vertical direction of the stick portion 11 so the hand of the user can rest on the hand grip portion and apply the weight downwardly onto the stick portion 11.

At the forward end of the hand grip 27 the handle turns downwardly and then downwardly and rearwardly to engage with the stick portion 11. This section is indicated generally at 28. At the rear end of the hand grip 27 the handle also turns downwardly to form a hook 29 which is useful for allowing the patient to hang the cane over a suitable support when not in use or when the cane hand is required for other purposes. This general shape of handle is, of course, known but in this case it has been modified in a number of ways to provide a substantially improved operation.

Thus the cross-section of the handle at the point indicated at 2—2 in FIG. 1 is circular as shown in FIG. 2. While the transverse dimension of the handle as illustrated at 30 in FIG. 2 remains substantially constant through to the hook portion 29, the dimension at right angles thereto illustrated at 31 varies through the handle to provide a number of different shaped sections. Thus the dimension 31 gradually increases through to the section taken along the lines 3—3 of FIG. 1 and shown in FIG. 3. This shows that the cross-section at that point has become more square with flat sides 32 and the upper and lower surfaces 33 flattened out of the semi-circular shape of FIG. 2. The sides 32 then remain substantially flat through to the hook portion 29 and carry roughening ridges 34 in a grid pattern or other suitable pattern to assist the patient in holding the cane even with very weak grip.

At the forward end of the hand grip 27 is provided a raised stop member 35 which as shown in FIGS. 1 and 3, is raised from the upper surface 33 and is integral with the body of the handle. The width of the projecting stop member 35 is the same as the upper surface 33 and gradually tapers toward a smoothly curved upper edge of the stop member 35. As shown in FIG. 4, the cross-section of the handle within the hand grip section 27 immediately adjacent the stop member 35 has a reduced height dimension 31 so that while the lower surface 33 remains contiguous with the lower surface of the section of FIG. 3, the upper surface is reduced in height so as to flatten the section and allow it to be more readily grasped by the patient. The section at 4—4 therefore is effectively square with rounded corners providing a flat upper surface 332, flat sides 32 and a flat bottom.

The handle is so shaped that the highest point excluding the projecting stop member 35 occurs substantially at the rear end of the hand grip 27, that is on the opposite side of the vertical axis through the stick portion 11 relative to the stop member 35. The highest point is indicated at 36 and from that point the upper surface of the handle gradually curves downwardly into the hook portion 29. Thus the upper surface of the hand grip 27 is inclined downwardly from the highest point 36 to the intersection with the stop member 35. The angle of downward inclination indicated at 37 is of the order of 20 degrees but can lie in the range 10 degrees to 25 degrees.

The height dimension 31 of the hand grip 27 gradually increases up to the highest point 36 and then gradually decreases through the hook portion 29 with the lowermost end of the hook portion 29 being effectively pointed relative to the remainder of the cross section to allow it to be readily hooked over suitable supports.

The shape of the handle allows the user to place his hand on the hand grip. The pistol grip shape of the hand grip 27 allows it to be easily grasped with the roughened sides helping to maintain the hand grip within the hand of the user even if the user has a very weak grip. The inclined upper surface 332 causes the hand of the user to tend to fall forwards into the junction between the projection 35 and the surface 332 so that the portion of the hand between the forefinger and thumb engages over this intersection and prevents even a weak grip from slipping over the hand grip forwardly of the handle. The hand therefore is properly placed on the hand grip with the weight placed directly on the hand grip which lies effectively directly over the vertical axis of the stick portion 11. The highest point 36 occurring at the rear or toward the rear end of the hand grip 27 allows the major part of the weight to be positioned at this point and then it can roll forwards as the user and his hand moves forward relative to the stick. Thus if the stick is behind the user after a step, the weight from the hand of the user is rolled forwardly on the hand grip to a position forward of the vertical axis of the stick portion so the stick tends to roll forwardly about the pivot provided by the tip and come back to the user's side for the next step.

As an alternative method of use, the user can grasp the stick at the highest point 36 using effectively the first two fingers of the hand and the thumb. In this case the flattened sides are particularly effective so the thumb can lie along the side.

The handle therefore is effectively and scientifically designed to ensure that the hand of the user is properly placed and remains effectively and properly positioned so the stick provides the best support and cannot slip away from the hand of the user even if the grip is weak.

Figure 6:
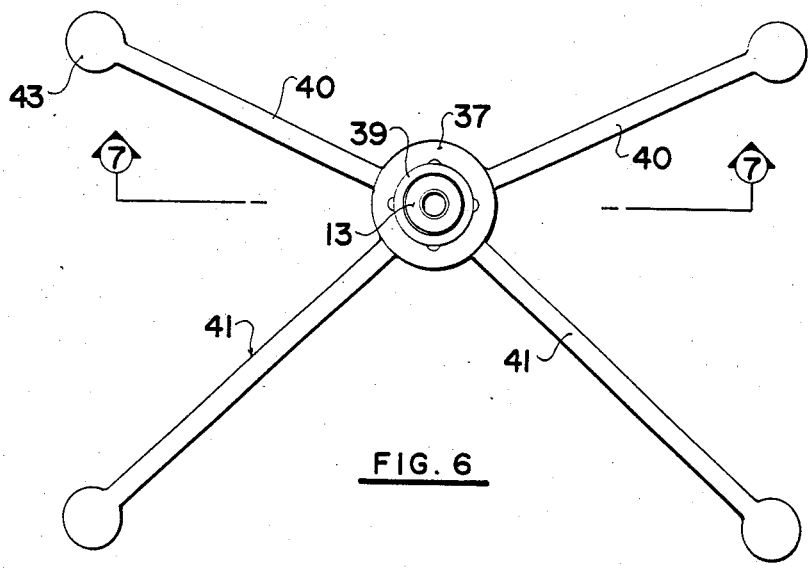
FIG. 6 is a plan view of a quad bottom for attachment to the cane of FIGS. 1 through 5.
Figure 7:
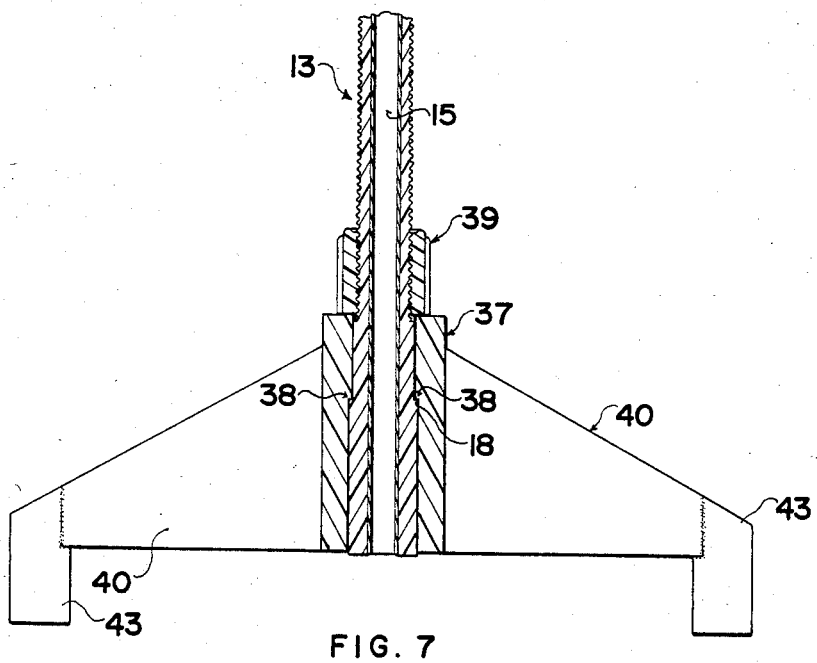
FIG. 7 is a cross sectional view of the lower end of the cane of FIG. 5 with the single tip removed and the quad bottom from FIG. 6 attached.

Turning now to FIGS. 6 and 7, the construction of the sections 12 and 13 using the screw thread interconnection and lock nut 24 is particularly effective in allowing the stick to accept a quad bottom as an alternative for the simple tip 19.

The quad bottom comprises a tubular support member 37 which has an internal shoulder 38 for cooperating with the shoulder 18. The inner surface of the tubular member 37 is not threaded but a lock nut 39 can be screwed down the screw thread 16 to compress the tubular member 37 between the shoulder 38 and the lock nut 39. The tubular member carries four outwardly extending plates 40, 41 which are basically of triangular shape with one side of the triangle integral with the tubular member 37 and the apex of the triangle supporting a cylindrical leg 43, the axis of which lies parallel to that of the stick portion 11 and therefore the tubular member 37. The plates 40 in known manner are arranged at a shallower angle than the plates 41 so that the plates 40 can follow alongside the foot of the user with the plates 41 extending further out to provide a rectangular base for the cane.

The legs 43, plates 40, 41 and the tubular member 37 are all moulded from the same material and in the same manner as the previous sections of the cane and in this way provide a very light weight and effective quad bottom which is a weight of approximately 50% of the conventional type and yet provides similar strength and rigidity. Furthermore the method of attachment allows the user to change from the tip 19 to a quad bottom using the same cane and with a few minutes modification work.

As an alternative arrangement, the male portion of the handle can include a stepped reduced section which projects into the metal tube at the upper end of the stick portion to improve structural strength. In addition, a raised ring (0.003 inches) can be moulded into the male portion approximately 0.5 inches from the end of the stick portion to further improve strength and to reduce any creaking noises which could be disconcerting for the infirm user.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

We claim:

1. A walking cane including a stick portion and a handle, the handle comprising a hand grip portion which has a forward end and a rear end and is of elongate generally cylindrical shape free from encumberances from said forward end to said rear end whereby it can be wrapped around by the hand of the user between said forward and rear ends with the fingers wrapped in one direction and the thumb in the opposed direction and which lies generally at right angles to the length of the stick portion, means interconnecting said forward end to one end of said stick portion, the handle being shaped such that, with the stick portion vertical, a portion of an upper surface of the hand grip portion is inclined downwardly toward said forward end and a portion inclined downwardly toward said rear end and such that an extrapolation of the stick portion intersects the hand grip portion intermediate its length, and a stop member projecting upwardly from the forward end of the hand grip portion to form a junction between said stop member and said hand grip portion, the upper surface of the hand grip portion adjacent the stop member being flattened from a circular cylindrical shape, a width dimension of the stop member at the junction being the same as that of the hand grip portion and the junction being smoothly curved to receive and locate a portion of the hand of the user.

2. A cane according to claim 1 wherein the upper surface is inclined downwardly toward said stop member from a position on the opposite side of said extrapolation relative to said stop member.

3. A cane according to claim 1 wherein the angle of inclination is greater than 10 degrees.

4. A cane according to claim 1 wherein the under surface of said hand grip is smooth and free from encumbrances between said rear end and said forward end so as to receive all fingers of the hand of the user and wherein the under surface at said forward end turns downwardly and then turns downwardly and rearwardly to connect to said stick portion.

5. A cane according to claim 1 wherein the upward thickness of the handle on the hand grip side of said stop member is reduced relative to the upward thickness on the other side of said stop member whereby said hand grip portion is flattened.

6. A cane according to claim 1 wherein the handle is moulded from an instant setting polymeric plastics material.

7. A cane according to claim 6 wherein the material is Duramax 100.

8. A walking cane including a stick portion and a handle, the handle comprising a hand grip portion which has a forward end and a rear end and is of elongate cylindrical shape free from emcumberances from said forward end to said rear end whereby it can be wrapped around by hand of the user between said forward end and said rear end with the fingers wrapped in one direction and the thumb in the opposed direction and which lies generally at right angles to the length of the stick portion, means interconnecting said forward end to one end of said stick portion, the handle being shaped such that, with the stick portion vertical, a portion of an upper surface of the hand grip portion is inclined downwardly towards said forward end and a portion inclined downwardly towards said rear end and such that an extrapolation of the stick portion intersects the hand grip portion intermidiate its length, and a stop member projecting outwardly from said forward end such that the junction between said stop member and said hand grip portion is shaped to receive and locate a portion of the hand of the user wherein the stick portion comprises two separate cylindrical sections, one having a male screw thread at one end thereof and the other having an axial bore at one end for receiving the first section and a cooperating female screw thread on the surface of the bore whereby said one ends of said sections can be interconnected and the axial extent of the stick portion can be adjusted by rotating one section relative to the other, and includes a lock collar having an internal screw thread for cooperating with the male screw thread so as when screwed thereon to abutt said one end of said section having said screw threaded axial bore to look the sections in a desired adjusted position, the lock collar and screw threads of the sections being moulded from a polymeric material.

9. A cane according to claim 8 wherein the sections are tubular and each includes a rigid metal tube inside, coaxial and integral with polymeric material to add strength and resist bending.

10. A cane according to claim 9 wherein the metal tube of said other section terminates at the end of the female screw thread remote from the end of the section so that all of said female screw thread is of said polymeric material 11. A cane according to claim 10 wherein said other end of said other section includes a bore receiving in shrink fit a male portion of said handle, said metal tube terminating at the end of said male portion remote from the handle.

12. A cane according to claim 10 wherein said one section includes an unthreaded portion at the end thereof remote from said other section providing a peripheral shoulder whereby said unthreaded portion can receive one of a tubular ground engaging tip and a quad bottom having a tubular support which provides a cooperating shoulder whereby the tubular support can be engaged on said peripheral shoulder by passing over said screw thread and locked against said shoulder by a screw threaded lock collar.

13. A cane according to claim 12 wherein the quad bottom is formed from instant setting polymeric material and comprises the tubular member, four flat plate members each attached to and extending in a radial plane from said tubular member with one edge of the plate against said tubular member and each carrying a cylindrical leg at an opposite edge remote from said tubular member, the axis of each leg being parallel to the tubular member.

* * * * *